US009493949B2

(12) United States Patent
Yau et al.

(10) Patent No.: US 9,493,949 B2
(45) Date of Patent: Nov. 15, 2016

(54) PANEL AND PANEL STRUCTURE FOR VENTILATION AND BOTH REACTIVE AND DISSIPATIVE SOUND DAMPENING

(71) Applicants: Vicking Wai King Yau, Burnaby (CA); James Higgins, North Vancouver (CA)

(72) Inventors: Vicking Wai King Yau, Burnaby (CA); James Higgins, North Vancouver (CA)

(73) Assignee: Vanair Design, Buenaby (CA)

( * ) Notice: Subject to any disclaimer, the term of this patent is extended or adjusted under 35 U.S.C. 154(b) by 0 days.

(21) Appl. No.: 14/221,250

(22) Filed: Mar. 20, 2014

(65) Prior Publication Data

US 2015/0267404 A1 Sep. 24, 2015

(51) Int. Cl.

| | |
|---|---|
| ***E04C 2/34*** | (2006.01) |
| ***E04C 2/52*** | (2006.01) |
| ***E04B 1/99*** | (2006.01) |
| ***G10K 11/172*** | (2006.01) |
| ***F24F 13/02*** | (2006.01) |
| *E04B 1/86* | (2006.01) |
| *E04B 2/74* | (2006.01) |
| *E04B 1/84* | (2006.01) |
| *F24F 13/24* | (2006.01) |

(52) U.S. Cl.

CPC ..... *E04C 2/523* (2013.01); *F24F 13/0227* (2013.01); *G10K 11/172* (2013.01); *E04B 1/86* (2013.01); *E04B 2/7409* (2013.01); *E04B 2001/8452* (2013.01); *F24F 2013/242* (2013.01); *F24F 2013/245* (2013.01)

(58) Field of Classification Search

CPC .... F24F 13/24; F24F 2013/245; F24F 13/26; E04C 2/523; E04C 2/34; E04C 2/52; E04B 1/86; E04B 2/7409; E04B 2001/8452; E04B 1/99

USPC ..... 52/144, 145, 783.1, 783.19, 787.11, 52/794.1, 795.1; 181/198, 284, 293

See application file for complete search history.

(56) References Cited

U.S. PATENT DOCUMENTS

| | | | | | |
|---|---|---|---|---|---|
| 1,033,963 | A * | 7/1912 | Surprise | F24F 13/24 | 138/42 |
| 2,051,613 | A * | 8/1936 | Macleod | F24F 7/013 | 454/206 |
| 2,079,878 | A * | 5/1937 | Sabine | 52/204.593 | |
| 2,202,339 | A * | 5/1940 | Dresser | E06B 7/02 | 181/256 |
| 2,271,871 | A * | 2/1942 | Newport | E04B 9/001 | 181/284 |

(Continued)

*Primary Examiner* — Phi A

(74) *Attorney, Agent, or Firm* — Susan M. Ben-Oliel

(57) ABSTRACT

A passive ventilation panel and system, in particular for use in doors, ceilings, walls and partitions enables an exchange of supply and return air for at least one room or a room, without the need for additional ventilation equipment, such as ducts, and without the needs to install wall openings or grills for the supply and exhaust air in the space.

19 Claims, 12 Drawing Sheets

(56) References Cited

U.S. PATENT DOCUMENTS 2,502,016 A * 3/1950 Olson ..... E04B 1/8209 181/295
2,674,336 A * 4/1954 Lemmerman ..... 181/222
2,681,000 A * 6/1954 Redmond, Jr. ..... F24F 13/08 454/261
2,704,504 A * 3/1955 Wilkening ..... E06B 7/02 181/224
3,507,356 A * 4/1970 Smith ..... F15D 1/0015 181/224
4,023,617 A * 5/1977 Carlson et al. ..... 165/169
4,047,519 A * 9/1977 Nett ..... B08B 15/02 126/299 D
4,164,265 A * 8/1979 Kucharczyk ..... F24F 13/24 181/224
4,317,503 A * 3/1982 Soderquist et al. ..... 181/290
4,466,505 A * 8/1984 Ritter ..... 181/144
4,660,676 A * 4/1987 Eustace ..... F24F 13/24 181/224
4,706,422 A * 11/1987 Ashton ..... E04B 2/7411 181/224
5,332,872 A * 7/1994 Ewanek ..... F04D 29/663 181/224
5,386,779 A * 2/1995 Baker ..... F24F 13/24 102/302
5,457,291 A * 10/1995 Richardson ..... 181/293
6,007,890 A * 12/1999 DeBlander ..... B32B 3/26 181/288
6,568,135 B1 * 5/2003 Yokoyama et al. ..... 52/145
6,589,112 B2 * 7/2003 Ruach ..... F24F 13/02 181/224
6,619,003 B2 * 9/2003 Von Arx et al. ..... 52/222
6,758,305 B2 * 7/2004 Gelin et al. ..... 181/285
6,781,829 B2 * 8/2004 Hein ..... 361/679.33
7,721,847 B2 * 5/2010 Coury ..... 181/293
8,006,442 B2 * 8/2011 Cheng et al. ..... 52/144
8,371,419 B2 * 2/2013 Nonogi et al. ..... 181/290
8,640,427 B2 * 2/2014 Briggs et al. ..... 52/784.11
9,109,389 B1 * 8/2015 Crittenden ..... E06B 3/5892
2009/0038883 A1 * 2/2009 Kim ..... 181/291
2009/0307996 A1 * 12/2009 Berger ..... 52/144

* cited by examiner

98 & 100 Resonator Cavities, can be filled with sound absorptive material
88
84
92

DETAIL A

DETAIL C
92
86

SECTION B-B
84
92
86
C
A
88
B
92
84
96
94
92 (Slotted Mounting)
90
96
86

SECTION A-A

DETAIL B

DETAIL A

PANEL AND PANEL STRUCTURE FOR VENTILATION AND BOTH REACTIVE AND DISSIPATIVE SOUND DAMPENING

FIELD OF THE INVENTION

The present invention relates to the field of ventilation panels for use in doors, walls, ceilings and partitions.

BACKGROUND ON THE INVENTION

The primary function of interior walls, partitions and doors is to divide building space into separate, private spaces. In construction, there have been, over the past 5-10 years increasing demands for and efficiencies in the development of closed spaces which are sound insulated. With regards to walls, when additional thermal and/or acoustic insulation is needed, insulation medium such as fibreglass, rock wool or mineral wool will commonly be placed to fill the interior space between vertical studs and gypsum board panels. Sound transmission through walls can be reduced by widening the wall and staggering the studs such that no stud spans the full width of the wall.

For the occupants of such spaces, while reduction in sound transmission and heat/AC efficiencies are important, even more important planning aspects relating to health and comfort. Excellent air quality is especially essential and can only be achieved if "used" air is regularly replaced by new or fresh air. If a space becomes essentially "airtight", this air exchange does not adequately occur without costly "active" ventilation methods.

Passive ventilation allows rooms to ventilate while windows and doors are closed. This reduces condensation and provides a healthy air exchange. Passive ventilation may be achieved by either the installation of transfer ducts in the ceiling or walls between two closed spaces and/or the installation of grills in or around a doorway. In regards to ducts, these must be custom sized and installed on site during building construction or during a major renovation. With regard to grills, these are seen as aesthetically displeasing. An example of an after-market grill to retrofit on standard doors is made by Tamarack Technologies Inc. A drawback of all such door grills is the lack of acoustic privacy. The grill simply provides a thoroughfare air channel from one space (for example a corridor) to another space (for example, an office). Neither privacy nor sound attenuation is considered with regard to these grills.

There remains a need for a passive ventilation system which attenuates sound and which can adequately address these and other challenges.

It is an object of the present invention to obviate or mitigate the above disadvantages.

SUMMARY OF THE INVENTION

It is an object of the present invention to provide a passive ventilation panel and system, in particular for use in doors, ceilings, walls and partitions, which enables an exchange of supply and return air for at least one room or a room, without the need for additional ventilation equipment, such as ducts, and without the needs to install wall openings or grills for the supply and exhaust air in the space.

It is another object of the present invention to provide a passive ventilation panel and system having the above characteristics which can effectively attenuate noises in a relatively wide range of frequencies.

It is an object of the present invention to provide a passive ventilation panel and system which enables air exchange between at least two spaces/rooms by way of a combination of i) a staggered, non-linear configuration of vertical air inlet and outlet vents, forming a Z-shaped channel of air flow; ii) a plurality of horizontally dispersed staggered baffles and iii) a plurality of resonators peripheral to said baffles.

The present invention provides a panel for ventilation and both reactive and dissipative sound dampening which comprises:

a) a front, a back, a top, a bottom, a right side and a left side defining a hollow centre there between;

b) at least one vertically oriented ventilation groove on the front of the panel (front groove) for passive air passage to the hollow centre and at least one vertically oriented ventilation groove on the back of the panel (back groove) for passive air passage to the hollow centre, wherein the front groove and the back groove are non-linear, staggered and form a Z-shaped air channel within the hollow centre;

c) a plurality of horizontally dispersed, staggered baffles in the hollow centre; and d) a plurality of at least partial resonators on the periphery of the hollow centre.

The present invention further provides a panel structure for ventilation and both reactive and dissipative sound dampening which comprises a frame disposed between a front surface and a back surface, wherein frame comprises at least two rails and two stiles and a slotted muntin and wherein said frame is disposed between the front surface and the back surface to form a hollow cavity defining in part a Z-shaped airflow pathway, from at least one vertically oriented ventilation groove on the front surface (front groove) for passive air passage to the hollow cavity and at least one vertically oriented ventilation groove on the back surface (back groove) for passive air passage to the hollow cavity, wherein the front groove and the back groove are non-linear and staggered and wherein at a right side and left side of the cavity, through a plurality of slots in the muntin, there are a plurality of resonators; and wherein, pressed between the front surface and the back surface are situate a plurality of staggered horizontally oriented baffles.

The present invention additionally comprises a door comprising at least one of the above-noted panels and/or panel structures.

The present invention additionally comprises a wall comprising at least one of the above-noted panels and/or panel structures.

The present invention additionally comprises a partition comprising at least one of the above-noted panels and/or panel structures.

The present invention additionally comprises a window comprising at least one of the above-noted panels and/or panel structures.

The present invention additionally comprises a panel system comprising:

a) at least one panel, said panel comprising: a front, a back, a top, a bottom, a right side and a left side defining a hollow centre there between; at least one vertically oriented ventilation groove on the front of the panel (front groove) for passive air passage to the hollow centre and at least one vertically oriented ventilation groove on the back of the panel (back groove) for passive air passage to the hollow centre, wherein the front groove and the back groove are non-linear and staggered and form a Z-shaped air channel within the hollow centre; a plurality of horizontally dispersed, staggered baffles in the hollow centre; and a plurality resonator necks on the periphery of the hollow centre;

b) a rail; and c) at least two stiles comprising resonator cavities, said stiles and cavities defining a groove into which resonator necks are mated, to secure panel and stile together.

A method of providing ventilation and both reactive and dissipative sound dampening between two spaces which comprises placing a panel and/or panel structure, as described above (as a whole or part of a door, wall, ceiling, partition or window) between said two spaces.

Without limiting the general range of applications, the panels, systems, and methods of the present invention are especially suited to use in doors, walls, partitions, ceilings and floors, in residential, commercial and industrial contexts.

Some advantages of the invention include, without limitation, the ability of the panels to provide ventilation to an enclosed space without installing a vent while reducing the amount of sound transmission significantly as compared to an "open" vent. The panels in accordance with the invention can be used in a variety of contexts, including the formation of doors, which can be used easily to replace existing doors, therein to provide a simple, inexpensive means of providing passive ventilation/airflow while not compromising sound attenuation.

These and other objects and advantages of the present invention will become more apparent to those skilled in the art upon reviewing the description of the preferred embodiments of the invention, in conjunction with the figures and examples.

BRIEF DESCRIPTION OF THE DRAWINGS

The following figures set forth embodiments in which like reference numerals denote like parts. Embodiments are illustrated by way of example and not by way of limitation in all of the accompanying figures in which.

PREFERRED EMBODIMENTS OF THE INVENTION

Figure 1:
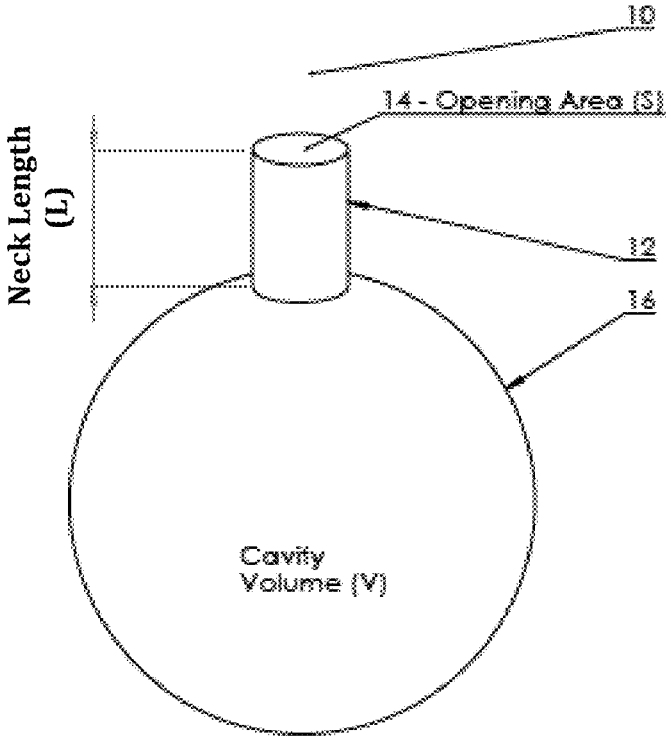
FIG. 1 is an illustration of a resonator cavity.

A detailed description of one or more embodiments of the invention is provided below along with accompanying figures that illustrate the principles of the invention. As such this detailed description illustrates the invention by way of example and not by way of limitation. The description will clearly enable one skilled in the art to make and use the invention, and describes several embodiments, adaptations, variations and alternatives and uses of the invention, including what we presently believe is the best mode for carrying out the invention. It is to be clearly understood that routine variations and adaptations can be made to the invention as described, and such variations and adaptations squarely fall within the spirit and scope of the invention.

In other words, the invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured. Similar reference characters denote similar elements throughout various views depicted in the figures.

This description of preferred embodiments is to be read in connection with the accompanying drawings, which are part of the entire written description of this invention. In the description, corresponding reference numbers are used throughout to identify the same or functionally similar elements. Relative terms such as "right", "left" "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral", "adjacent" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. Interconnected, as used herein, generally refers to the relationship between the platforms and adjacent blocks. The term "operatively connected" is such an attachment, coupling or connection that allows the pertinent structures to operate as intended by virtue of that relationship. In particular, the terms "right" and "left" are used in the claims but could easily be substituted for one another. In fact, as a panel is rotated 180 degrees in either direction, right becomes left, as so on.

In the present disclosure and claims (if any), the word "comprising" and its derivatives including "comprises" and "comprise" include each of the stated integers but does not exclude the inclusion of one or more further integers.

The terms "an aspect", "an embodiment", "embodiment", "embodiments", "the embodiment", "the embodiments", "one or more embodiments", "some embodiments", "certain embodiments", "one embodiment", "another embodiment"

and the like mean "one or more (but not all) embodiments of the disclosed invention(s)", unless expressly specified otherwise.

The term "variation" of an invention means an embodiment of the invention, unless expressly specified otherwise. A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "a", "an" and "the" mean "one or more", unless expressly specified otherwise.

The term "plurality" means "two or more", unless expressly specified otherwise.

The term "peripheral" means of or relating to the area that is to at least one side of the area being examined/discussed/considered.

The term "herein" means "in the present application, including anything which may be incorporated by reference", unless expressly specified otherwise.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in a sentence "the car is coloured (e.g., red, blue or green) the term "e.g." explains that "red, blue or green" are examples of "colour". However, those colours listed are merely examples of "colours", and other colours are equally applicable.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is", and thus limits the term or phrase it explains.

The present invention provides a passive ventilation panel, panel structure and system which enables and both reactive and dissipative sound dampening as well as air exchange between at least two spaces/rooms by way of a combination of i) a staggered, non-linear configuration of vertical air inlet and outlet vents, forming a Z-shaped channel of air flow; ii) a plurality of horizontally dispersed staggered baffles and iii) a plurality of resonators peripheral to said baffles. Each element is described in further detail below.

Staggered, Non-Linear Configuration of Vertical Air Inlet and Outlet Vents, Forming a Z-Shaped Channel of Air Flow Within the scope of the invention, there is provided at least one vertically oriented ventilation groove on the front of a panel or surface (front groove) for passive air passage to the hollow centre and at least one vertically oriented ventilation groove on the back of the panel or surface (back groove) for passive air passage to the hollow centre, wherein the front groove and the back groove are non-linear, staggered and form a Z-shaped air channel within the hollow centre. Preferably, ventilation grooves are proximate to one side of the panel or surface.

No light passes through the channel due to this orientation. Furthermore, the vertical groove openings to the hollow centre decouple vibrations of the front and back, so sound energy is dissipated.

It is important to understand that when sound waves strike a surface, some of the energy is usually reflected while some is transmitted through the surface. A typical objective in reducing sound transmission through a structure is to isolate the source from the structure before the energy can be transmitted to the structure, causing the structure to vibrate. The primary ways to reduce sound transmission through multi-component structures is to add mass and to decouple or isolate individual components so that vibrations cannot be passed from one component to the next. Decoupling can be done in many ways and, in accordance with the invention it is accomplished as follows:

Plurality of Horizontally Dispersed Staggered Baffles (Sound Dissipation/Absorption)

Absorptive or dissipative silencers use sound absorbing materials to attenuate sound waves. Dissipative silencers are widely used, for example, in HVAC duct systems. Typical dissipative silencers are configured in a parallel baffle arrangement.

Within the present invention, a plurality of horizontally dispersed/staggered baffles dissipates and absorbs sound within the panel or panel structure. In this way, sound absorptive material in cavity shaped and arranged (shaped similar to double wedge airfoils and staggered) to minimize line-of-sight so it is more likely sound will be incident on the material and be absorbed, while still allowing large open areas for air to flow. The shape of baffle, if desired, may be long to damp a larger frequency range, extending into lower ranges, for sound travelling normal to duct orientation. Baffle length can be adjusted based on size of door, partition, wall or window, as desired.

The thickness of the baffles may be selected with reference to the predominant frequency of the noise to be addressed (see Table 1). The incident sound energy is partially transformed to heat by causing motion in the fibers during its passage through the material.

Typical DIL—Dynamic Insertion Losses—with Absorptive Silencers are Indicated in Table 1 Below

| Diameter | Length | Frequency (Hz) | | | | | | |
|---|---|---|---|---|---|---|---|---|
| (inches) | (inches) | 125 | 250 | 500 | 1000 | 2000 | 4000 | 8000 |
| 4 | 24 | 8 | 14 | 26 | 34 | 41 | 45 | 25 |
| 5 | 24 | 6 | 12 | 22 | 28 | 37 | 38 | 22 |
| 6 | 24 | 5 | 10 | 18 | 23 | 33 | 30 | 19 |
| 8 | 24 | 4 | 9 | 17 | 22 | 29 | 25 | 18 |
| 10 | 36 | 6 | 11 | 21 | 27 | 39 | 25 | 19 |
| 12 | 36 | 5 | 9 | 18 | 23 | 32 | 20 | 18 |
| 16 | 36 | 5 | 8 | 11 | 23 | 19 | 17 | 15 |

• (1 in) = (25.4 mm)

It is important to understand that baffles are of a sufficient "depth" such that air travels into channels around the baffles (airflow channels) and not "over" or "under" the baffles, in situ. This true regardless of whether in situ refers to a panel (for example, rail and stile or "Dutch Shaker" style panels) or panel structure (for example face-frame-face or single panel structures), both described further below.

In this type of absorptive silencer, acoustic energy is converted to heat by the sound-absorbing processes which take place in the small interconnected air passages of fibrous or open-celled foam plastic materials of the baffle. They are used to provide attenuation of noise over a broad band of frequencies. Because of the frequency characteristics of the absorbing materials they employ, this type of silencer is much more effective at medium and high than at low frequencies.

Another very important factor which must be consider is the extra resistance to the flow of air which the baffle provides, which can be measured as a pressure drop across the baffle. Reducing the airway width too much will obviously increase this resistance to an unacceptable limit.

Excessive restriction of air flow will also have an effect on another important baffle parameter, the noise generated by the flow of air through the baffle. Forcing the air through narrow airways will obviously cause an increase in flow velocity, and therefore in the amount of this self-generated noise.

As such, there is a necessary balance between the requirements of good high frequency sound attenuation (i.e. narrow airways) and minimum flow resistance and silencer self-generated noise (requiring broad airways). Other factors which can affect the self-generated noise are changes of cross-section occurring within and at the ends of the baffle. It is also important that the sound-absorbent linings are kept as smooth as possible. In accordance with the present invention, baffle size and design allows a necessary balance between the requirements of good high frequency sound attenuation (i.e. narrow airways) and minimum flow resistance and silencer self-generated noise resistance and as such, airflow is only restricted within acceptable limits. Given the examples of baffle size, orientation and design provided herein, including via the Figures, a skilled party is given sufficient information to reproduce the invention.

Preferred sound absorbing materials for baffle are fibrous, lightweight and porous, possessing a cellular structure of intercommunicating spaces. It is within these interconnected open cells that acoustic energy is converted into thermal energy. Thus the preferred sound-absorbing material for the baffle is a dissipative structure which acts as a transducer to convert acoustic energy into thermal energy. The actual loss mechanisms in the energy transfer are viscous flow losses caused by wave propagation in the material and internal frictional losses caused by motion of the material's fibres. The absorption characteristics of a material are dependent upon its thickness, density, porosity, flow resistance, fibre orientation, and the like.

Common porous absorption materials are made from vegetable, mineral or ceramic fibres (the latter for high temperature applications) and elastomeric foams, and come in various forms. The materials may be prefabricated units, such as glass blankets, fibreboards, or lay-in tiles or foam or open cell plastic.

Preferably, the baffles in accordance with the invention comprise fibrous, acoustic media selected from the group comprising foam, butyl rubber and any other suitably sound absorptive matter if such matter i) absorbs sound waves and ii) reduces the level of noise.

Generally, the greater the length of the baffle, the greater amount of acoustic energy absorbed. However it is to be understood, as noted above, that two other parameters control the sound absorption: the thickness of each baffle and the size of the air space between the baffles.

In a preferred embodiment, the panel of the present invention further comprises a plurality, of spaced apart, generally parallel sound-attenuating baffles which extend horizontally across the hollow centre between the front and the back of a panel or within a frame between a front surface and back surface. In any case, the sound attenuating baffles are arranged in an off-set manner and define a plurality of through air passageways. Preferably, each of the sound attenuating baffles is substantially rectangular in cross section having first and second pairs of opposed faces. The sound attenuating baffles may also have other configurations, however, and include rectangles with rounded and pointed corners etc. . . . so as to effect the reflecting of the air between adjacent sound alternating baffles. In one embodiment, each panel (or space between a frame in a single panel structure) comprises four baffles. In another embodiment, each panel (or space between a frame in a single panel structure) comprises six baffles. In another embodiment, each panel (or space between a frame in a single panel structure) comprises eight baffles. Preferably, baffles are shaped similarly to double-wedge airfoil. Preferably, in addition to the baffles disposed within the hollow centre and staggered relative to each other, (such staggering as shown fully in the figures), there are additionally baffles are disposed within the hollow centre "lining" the cavity on two or more surfaces. These wall lining baffles are illustrated best in FIGS. 17-20.

Preferably, the baffles are comprised of at least one of acoustic tiles, fibreglass and acoustical foam.

It is important to understand that baffles are of a sufficient "depth" such that air travels into channels around the baffles (airflow channels) and not "over" or "under" the baffles, in situ. In the embodiment wherein Plurality of Resonators Peripheral to Said Baffles (Reflective or Reactive Silencers)

The primary function of a reactive silencer is to reflect sound waves back to the source. Energy is dissipated in the extended flow path resulting from internal reflections and by absorption at the source. The operation principle of the reactive silencers is a combination of lambda/4- and Helmholtz-resonators acting as acoustic filters. Reactive silencers have tuned cavities or membranes and are designed to attenuate low frequency noise.

Reactive silencers work by providing an impedance mismatch to the sound waves, causing reflection back towards the source, and by using destructive interference to 'tune out' particular frequencies. The attenuation produced depends on the dimensions of the pipes and chambers of the silencer. Reactive silencers can be very effective at reducing the amplitude of pure tones of fixed frequency, particularly if these are at low frequencies, where the absorptive type of silencer is ineffective. However, there can also be frequencies at which they allow sound to be transmitted with very little attenuation.

Figure 2:
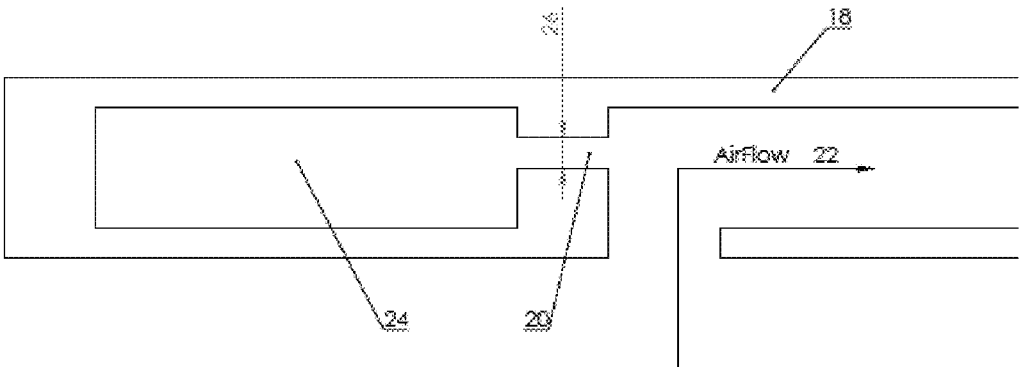
FIG. 2 is an illustration of both the Z-shaped airflow channel and an opening, neck and cavity of a sound attenuating resonator.

Preferably, the resonant cavities which provide reactive silencing to the panel are based on the Helmholtz resonator principle. So, within the second aspect of panel sound attenuation, in accordance with the present invention, it is preferred to incorporate Helmholtz Resonators into the periphery of the hollow centre. These are sound absorbing constructions that act like a mass-spring-damper system. As shown in FIG. 2, a cavity of air is enclosed in the side of the door 18 with a thin neck opening 20 to the flow pathway 22. Sound compresses and expands air in the cavity 24 that acts as a spring forcing a mass of air in and out of the neck 26. FIG. 2 as a cross-sectional view of a door, from the top, also illustrates, in part, the first part of the Z-shaped air channel within the hollow centre, formed by one vertically oriented ventilation groove on the front of the panel (front groove) for passive air passage to the hollow centre and at least one vertically oriented ventilation groove on the back of the panel (back groove) for passive air passage to the hollow centre. In other words, the front groove and the back groove are non-linear, staggered and form a Z-

Air flow pathway 22 is damped by viscous air forces and the skin friction in the neck (refer to FIG. 1 for simple graphic depiction of a Helmholtz resonator generally at 10, having neck 12 (with length L), opening 14 (with area S) and cavity 16 (with volume V). Referring to the labels in FIG. 2 and the speed of sound, c, the fundamental frequency that is absorbed by a Helmholtz Resonator is described by the equation:

$$f = \frac{c}{2\pi}\sqrt{\frac{d}{abL}}$$

Additionally, with reference to FIG. 1, absorptive material within the neck 12 and/or cavity 16 changes the amount of damping, the fundamental frequency, as well as the Q of the frequencies absorbed. Preferably, the panel of the present invention comprises a plurality of at least partial resonators formed on or part of the periphery of the hollow centre. In one aspect, the at least partial resonators are made whole by engagement of the panel with a stile, said stile comprising a remaining portion of the resonators (in other words, the entire resonator is created by the "mating" of the panel and stile. More preferably, the panel of the invention comprises necks of the resonators on the periphery of the hollow centre, said necks being mate-able with cavities of the resonators disposed within a stile, when said panel and stile are operably engaged.

A row of resonators, formed in one aspect by the mating of the panel (with the resonator neck) and the stile (with the resonator cavity) the dimensions of which may be similar or different is tuned to one or more frequencies constituting noise sources in the channels, or else to frequencies which are sufficiently close to one another to damp the noise within a range of frequencies. The tuning of the frequencies can be carried out by acting on the dimensions (length, width, height) of the cavities and necks and/or their shape so as to constitute Helmholtz resonators.

Frames, Panels and Panel Structures

A. Rail and Stile

In one aspect of the invention, frame and panel construction is employed. Frame and panel construction, also called rail and stile, is a woodworking technique often used in the making of doors, wainscoting, and other decorative features for cabinets, furniture, and homes (often referred to as "Shaker Style Panels") and, insofar as the present invention applies to doors, the "panel" described may simply be substituted for the base panel in conventional door, wall, partition and window manufacturing. The basic idea is to capture a 'floating' panel within a sturdy frame, as opposed to techniques used in making a slab solid wood cabinet door or drawer front, the door is constructed of several solid wood pieces running in a vertical or horizontal direction with exposed endgrains. Usually, the panel is not glued to the frame but is left to 'float' within it so that seasonal movement of the wood comprising the panel does not distort the frame. In any construction, there can be one or a plurality of panels.

Figure 3:
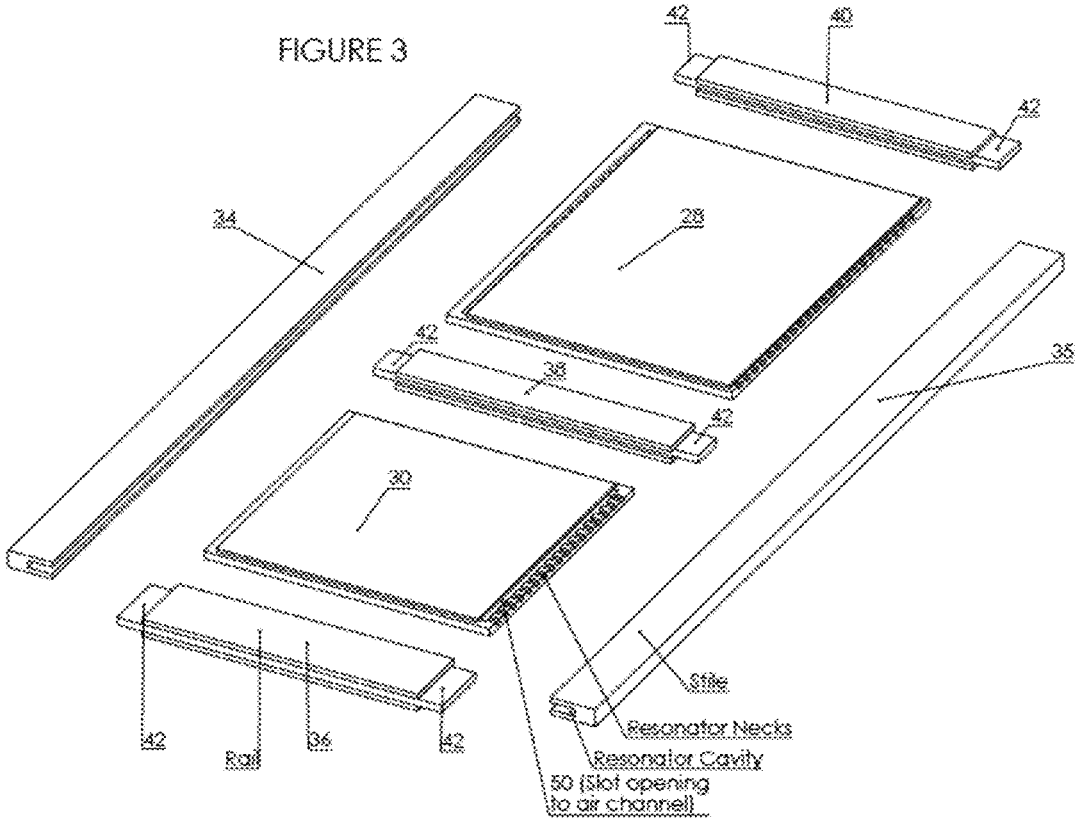
FIG. 3 is an exploded perspective view of a "rail and stile" door, with two centre panels.

As shown best in FIG. 3, frame and panel construction at its most basic consists of five members: panels 28 and 30 and the four members which make up the frame. The vertical members of the frame are called stiles (32 and 34) while the horizontal members are known as rails (36, 38 and 40). A basic frame and panel item consists of a top rail, a bottom rail, two stiles, and a one or more panels. This is a common method of constructing cabinet doors and these are often referred to as a five piece door (with one panel).

In larger structures (doors, walls, partitions, windows etc. . . . ) it is common to have more than two or three panels (divided into sections by rails). To house the extra panels, dividing pieces known as mid rails and mid stiles or muntins are added to the frame.

The panel is either captured in a groove made in the inside edge of the frame members or housed in an edge rabbet made in the rear inside edge. Panels are made slightly smaller than the available space within the frame to provide room for movement. Wood will expand and contract across the grain, and a wide panel made of solid wood could change width by a half of an inch, warping the door frame. By allowing the wood panel to float, it can expand and contract without damaging the door. A typical panel would be cut to allow ¼" (5 mm) between itself and the bottom of the groove in the frame. It is common to place some sort of elastic material in the groove between the edge of the panel and the frame before assembly. These items center the panel in the frame and absorb seasonal movement. A popular item for this purpose is a small rubber ball, known as a spaceball (a trademarked product). Some cabinet makers will also use small pieces of cork to allow for movement. The panels are usually either flat or raised.

A flat panel has its visible face flush with the front of the groove in the frame. This gives the panel an inset appearance. This style of panel is commonly made from man-made materials such as MDF or plywood but may also be made from solid wood or tongue and groove planks. Panels made from MDF will be painted to hide their appearance, but panels of hardwood-veneer plywood will be stained and finished to match the solid wood rails and stiles.

A raised panel has a profile cut into its edge so that the panel surface is flush with or proud of the frame. Some popular profiles are the ogee, chamfer, and scoop or cove. Panels may be raised by a number of methods—the two most common in modern cabinetry are by coving on the table saw or the use of a panel raising cutter in a wood router or spindle moulder.

In FIG. 3, stiles (32 and 34) are attached to rails (36, 38 and 40) by tongue (42 on each rail) inserted into groove 44, on each stile. Extending from the sides of each of panels 28 and 30 are necks 46 (i.e. partial resonators). Cavities 48 to complete resonator are disposed within groove 44 on stiles 32 and 34. It is important to note that, on each panel, necks 46 while extending sideways, extend from a top surface on a front of the panel and extend from a rear surface on a back of the panel. In this way, the neck openings are always exposed to the direction of air flow, which flows in a Z-shaped air channel (viewed in cross-section from the top of the structure), due to the orientation of the ventilation grooves, i.e. one vertically oriented ventilation groove on the front of the panel (front groove) for passive air passage to the hollow centre and at least one vertically oriented ventilation groove on the back of the panel (back groove) for passive air passage to the hollow centre, wherein front groove and back groove are offset (opposite sides and ends of such sides of each panel). In FIG. 3, front groove on panel 28 is shown as 50. Corresponding back groove on that same panel (28) is not visible on that Figure.

Figure 5:
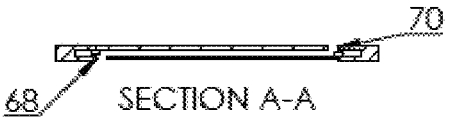
FIG. 5 is cross-section through B-B of FIG. 4.
Figure 4:
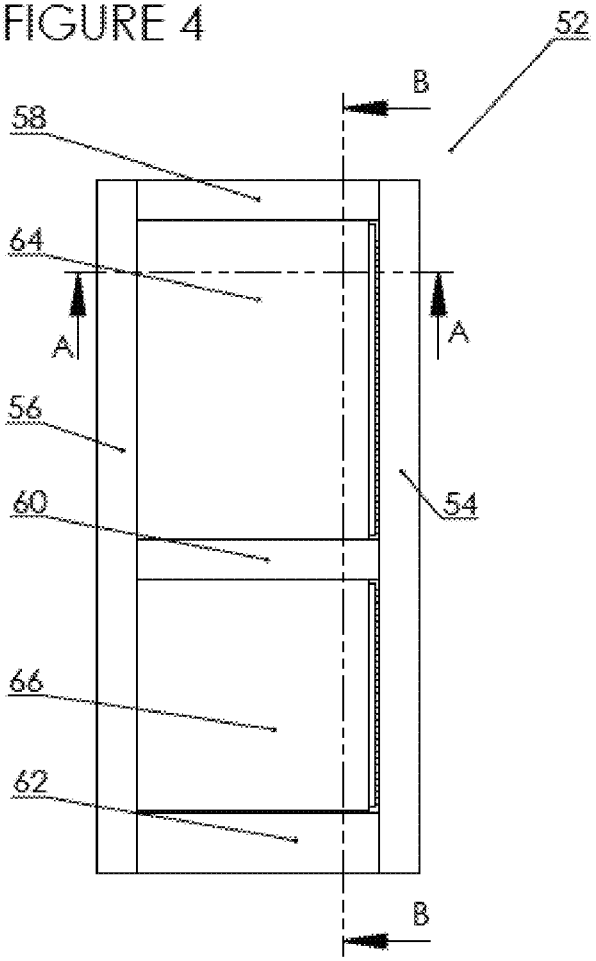
FIG. 4 is a front plan view of "rail and stile" door, with two centre panels.
Figure 6:
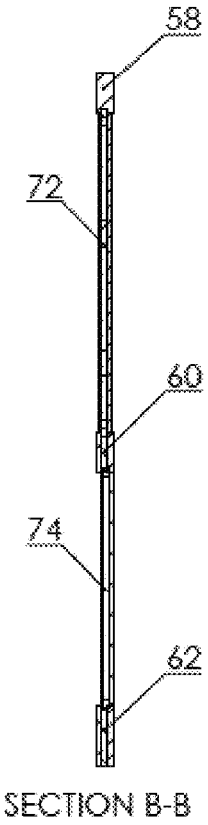
FIG. 6 is a cross-section through A-A of FIG. 4.

FIG. 4 illustrates a panel structure (for example a door) generally at 52 comprising stiles 54 and 56, rails 58, 60 and 62 and two panels 64 and 66. FIG. 5 is a cross-sectional view through line B-B of FIG. 4. This "top" cross-sectional view clearly shows 1) the off-set of front ventilation groove 68 and back ventilation groove 70 wherein the passive airflow channel forms a Z-shape. FIG. 6 is a cross-sectional view through line A-A of FIG. 4. This "side" cross-sectional view clearly shows the hollow chamber 72 formed within panel 64 and the hollow channel 74 formed within panel 66.

In this embodiment, within panels (for example 28 and 30) there is comprised the plurality of horizontally dispersed, staggered baffles 110. These are best shown in FIGS. 17-20, described further below. Preferably, in addition to the baffles 100 disposed within the hollow centre and staggered relative to each other, (such staggering as shown fully in the FIGS. 9, 17-20), there are additionally liner baffles 108 disposed within the hollow centre "lining" the cavity on two or more end or side hard surfaces. In this instance there are additional sound absorption benefits. Generally, it is desirable, when sound hits a surface to have absorption i.e. non-reflection. Such an absorptive effect is enhanced when the absorptive baffle is backed onto a hard surface, such the sides/ends of the panel or frame, as in 108.

B. Face-Frame-Face (Single Panel Face/Frame)

In another aspect of the invention, a pressed assembly method is employed in creation of a door. In this embodiment, an inner frame or rib is disposed between two veneers, surfaces or skins and the arrangement, so formed, provides reactive and dissipative sound dampening as well as ventilation there through. Inner frame or rib comprises a plurality of rails, stiles, and slotted muntins and when pressed between two veneers, surfaces or skins creates a "hollow panel", similar to the hollow panel described above. In the way, hollow space(s) are created in the center which becomes the air pathway and hollow spaces on the left and right sides open to the air pathway cavity through the slots in the muntins, become the sound absorptive resonators. The air pathway cavity comprises a plurality of staggered horizontally oriented baffles, shaped similar to a double wedge airfoil, that are pressed tightly between the two faces. Preferably, the resonator cavities are filled in whole or part with a sound absorption material, such as, for example, foam.

There is provided at least one vertically oriented ventilation groove on the front of the first surface (front groove) for passive air passage to the hollow centre and at least one vertically oriented ventilation groove on the back of the first surface (back groove) for passive air passage to the hollow cavity, wherein the front groove and the back groove are non-linear, staggered and form a Z-shaped air channel within the hollow cavity. So, a vertical slot for each airflow pathway cavity is routed in one surface face, and again on the opposite side of the surface face, to create a z-shaped airflow pathway (as viewed from the top).

The figures described herein show the surfaces/faces and the internal frame. The outside edge of each of the slots (routed through the surfaces/faces) line up with the inside edge of the slotted muntins (this is apparent in the dimensioning as well). These slots are on opposing sides and are the inlet and outlet for air to flow through the cavity created in the center.

Figure 7:
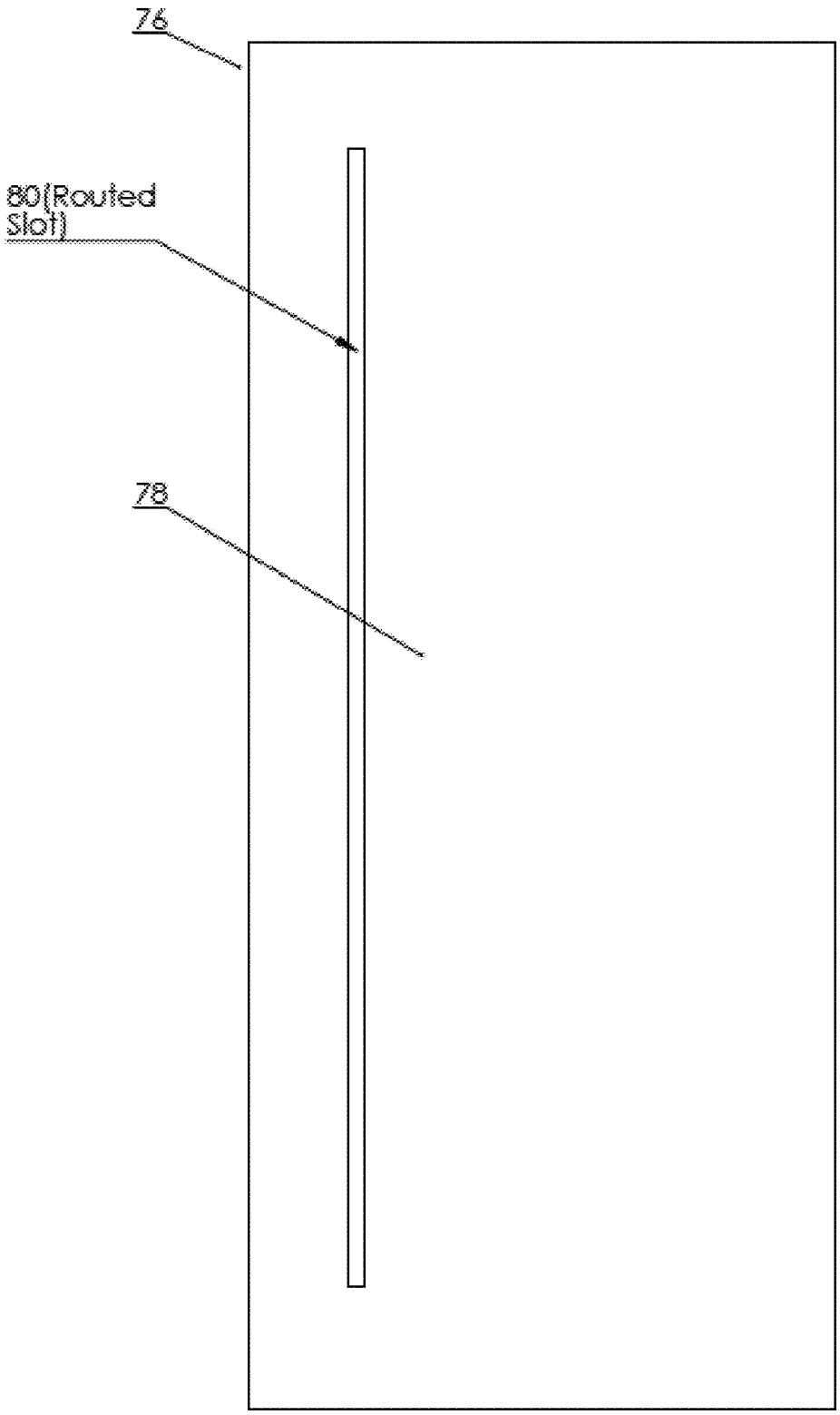
FIG. 7 is a front plan view of single panel door.
Figures 8, 9, 10, 11:
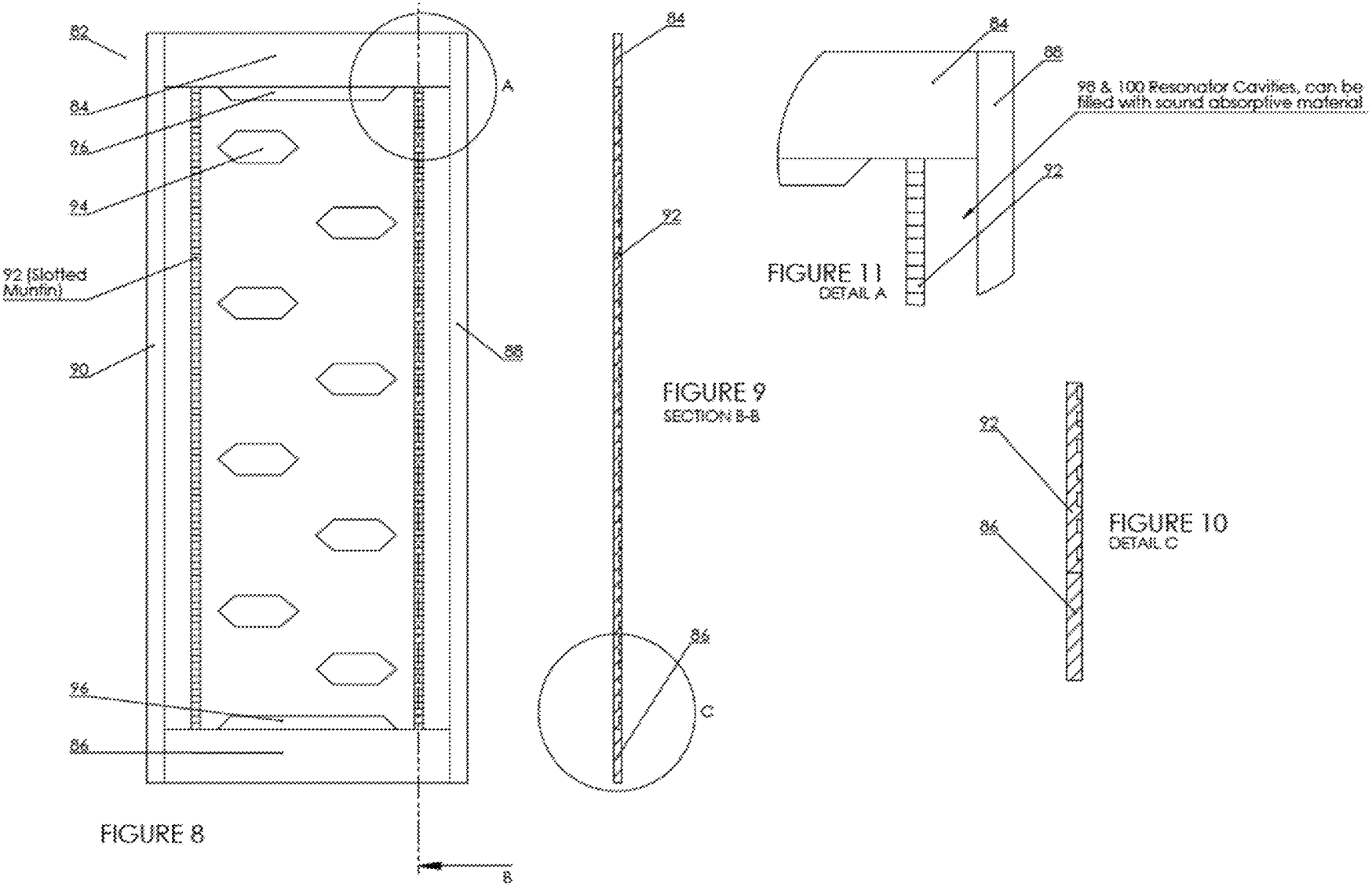
FIG. 8 is a front plan view of a frame or rib.
FIG. 9 is cross-section through B-B of FIG. 8.
FIG. 10 is a cross-section through A-A of FIG. 8.
FIG. 11 is an exploded front view of section A of FIG. 8.

FIG. 7 illustrates a door, generally at 76 comprising a front surface (or face) 78 and front ventilation groove 80. FIG. 8 illustrates a single panel frame (or rib), generally at 84 comprising rails 84 and 86, stiles 88 and 90, slotted muntin 92, staggered horizontal baffles 94, and liner baffles 96. FIG. 9 is a cross-section through B-B of FIG. 8 depicting slotted muntin 92 (forming resonator cavities 98—see FIG. 11), along with cross-section of rails 84 and 86. FIG. 10 shows detail C of FIG. 9 and specifically illustrates how slotted muntin 92 "create" the resonator cavities. FIG. 11 illustrates expanded (1:5) detail A of FIG. 8 showing space between slotted muntin 92, rail 84 and stile 88 and wherein foam 100 fills resonator cavity 98 between slotted muntin 92 and stile 88.

Figure 12:
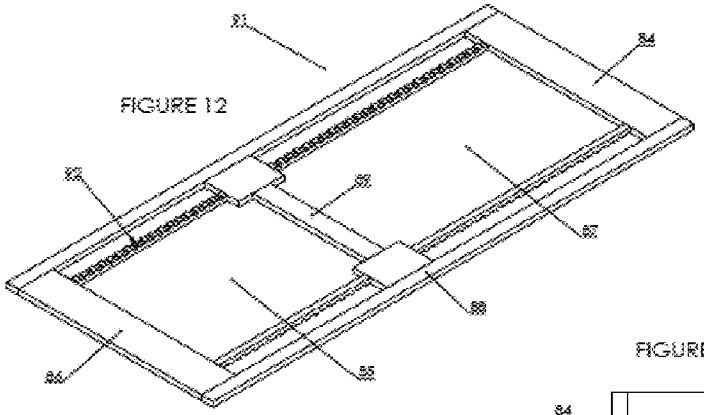
FIG. 12 is a perspective view of a frame or rib.
Figure 13:
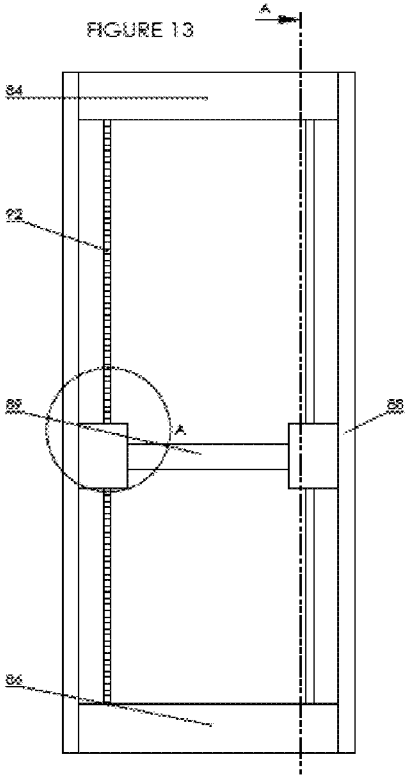
FIG. 13 is a front plan view of a frame or rib.
Figure 14A:
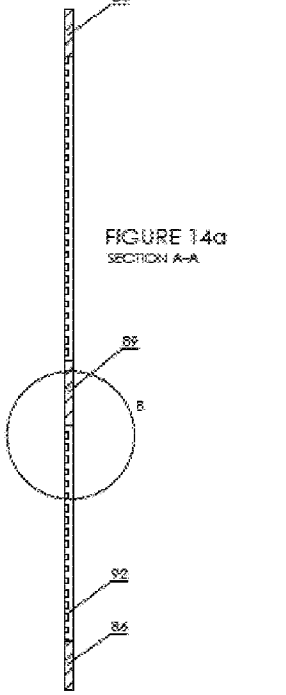
FIG. 14*a* is cross-section through C-C of FIG. 13.
Figure 14B:
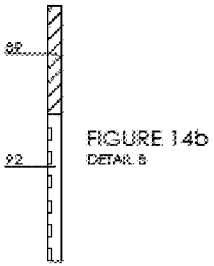
FIG. 14*b* is an exploded view of section E of FIG. 14*a;*
Figure 15:
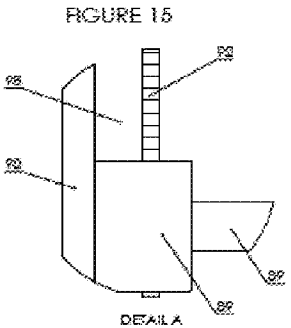
FIG. 15 is an exploded front view of section B of FIG. 13.

FIG. 12 similarly shows generally at 91 a frame or rib comprising rails 84 and 86, stiles 88 and 90, slotted muntin 92 and centre rail 89. For greater understanding, numerals 85 and 87 denote "open" spaces. FIG. 13 shows frame 91 with preferred door dimensions and indications of cross-section line C-C. FIG. 14*a* is said C-C cross-section across the hollow, showing rail 84, slotted muntin 92, centre rail 89 and rail 86. FIG. 14*b* further drills down to an exploded view over E (1:5) (shown in FIG. 14*a*) so that muntin forming resonator cavities can be seen. FIG. 15 further drills down to an exploded view over B (1:5) (shown in FIG. 13) so that space between slotted muntin 92, rail 84 and stile 88 and wherein resonator cavity 98 between slotted muntin 92 and stile 88 can be seen.

Figure 16:
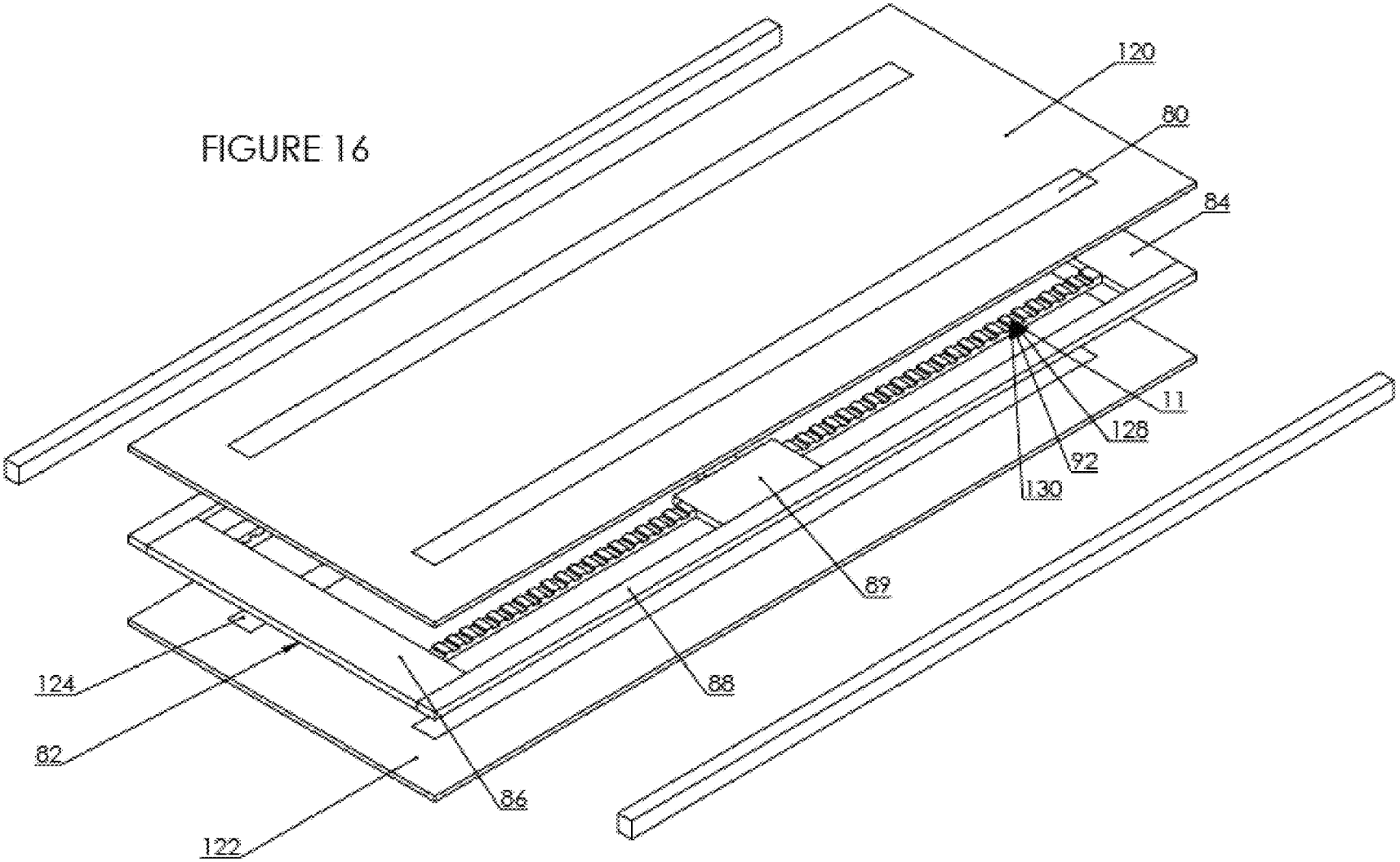
FIG. 16 is an exploded perspective view of a single panel door showing front surface (or face), back surface (or face) and intervening frame or rib.
Figure 17:
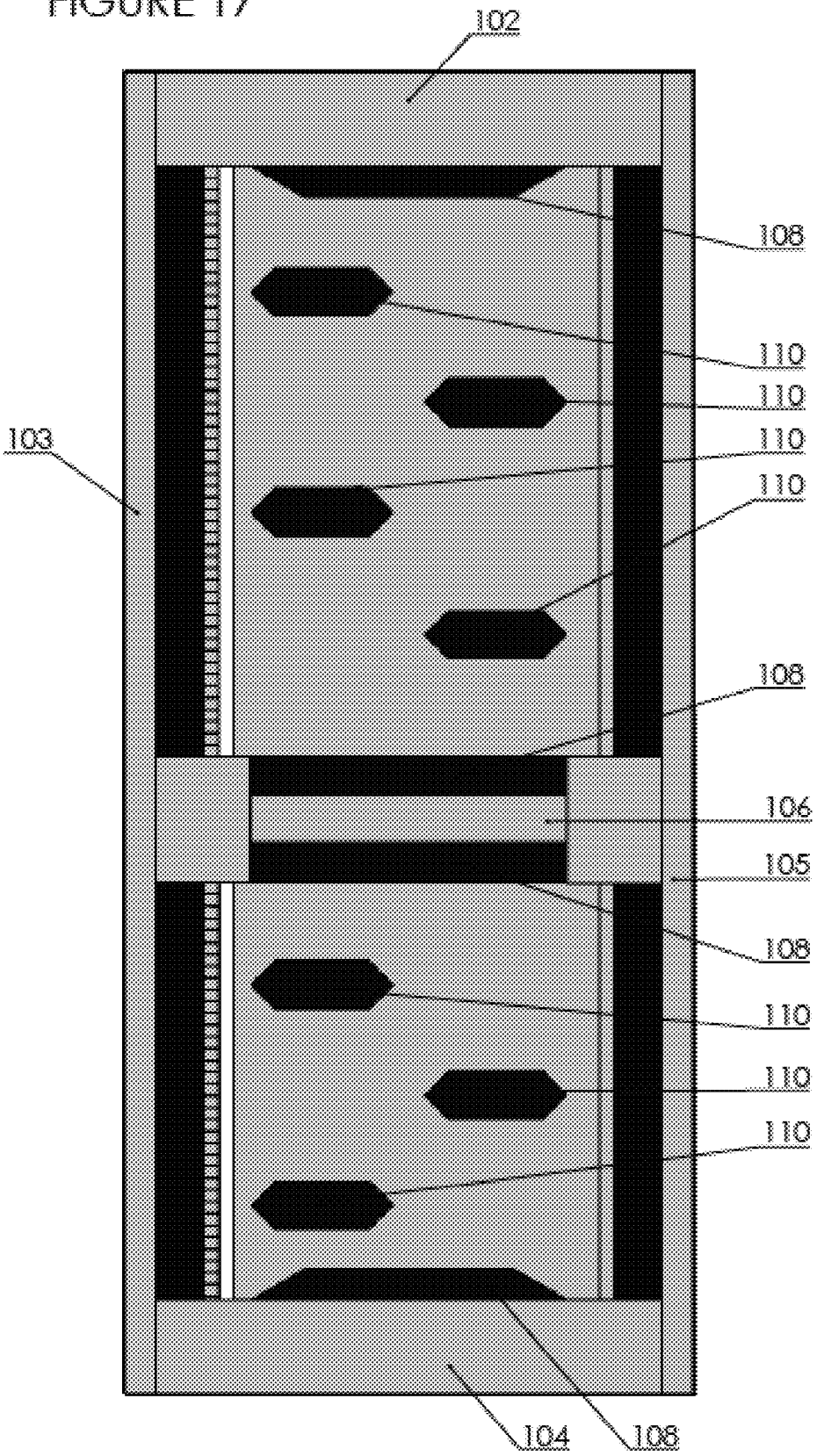
FIG. 17 is a photographic depiction of panel with baffles.
Figure 18:
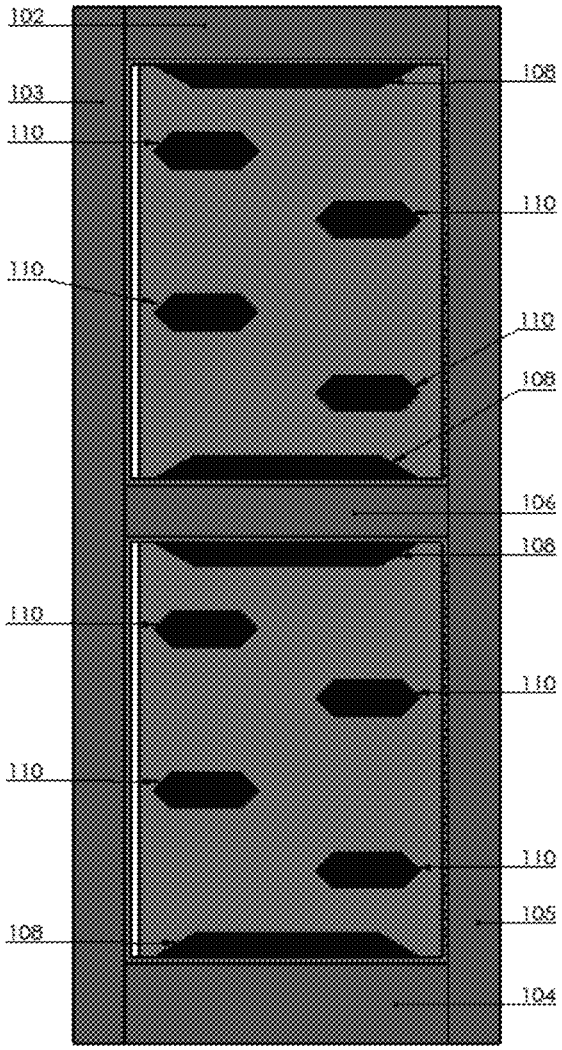
FIG. 18 is a photographic depiction of panel with baffles.

FIG. 16 depicts a single panel structure for ventilation and both reactive and dissipative sound dampening which comprises a frame (generally at 82) disposed between a front surface 120 and a back surface 122, wherein frame 82 comprises at least two rails (84 and 86) and two stiles (88 and 90) and a slotted muntin 92 and wherein said frame is disposed between the front surface 120 and the back surface 122 to form a hollow cavity defining in part a Z-shaped airflow pathway, from at least one vertically oriented ventilation groove on the front surface 80 (front groove) for passive air passage to the hollow cavity and at least one vertically oriented ventilation groove on the back surface 124 (back groove) for passive air passage to the hollow cavity, wherein the front groove and the back groove are non-linear and staggered and wherein at a right side and left side of the cavity, through a plurality of slots 126 in the muntin, there are a plurality of resonators (necks 128 and cavities 130); and wherein, pressed between the front surface and the back surface are situate a plurality of staggered horizontally oriented baffles (shown in FIGS. 17-20).

Figure 19:
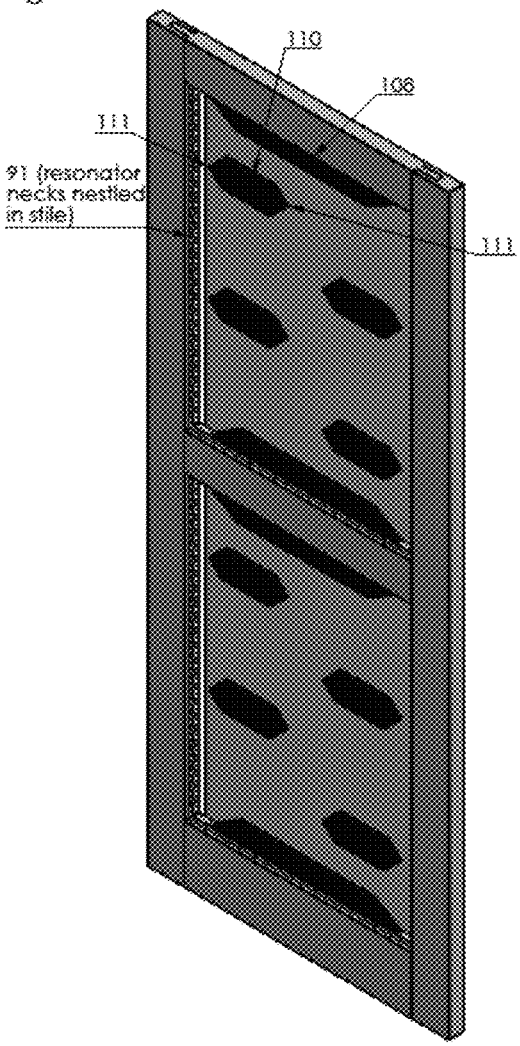
FIG. 19 is a photographic depiction of panel with baffles.
Figure 20:
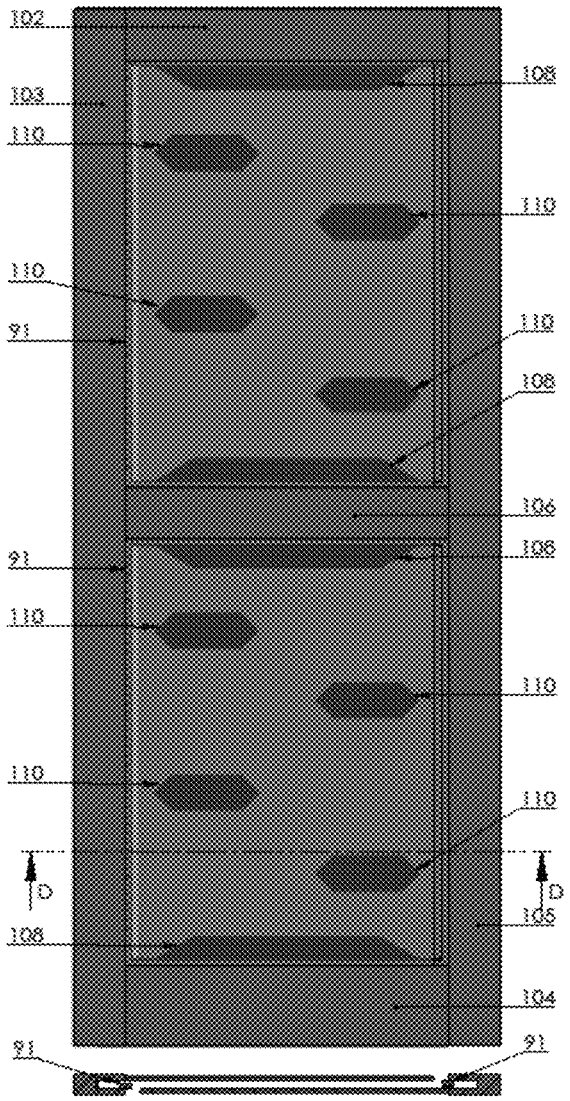
FIG. 20 is a photographic depiction of panel with baffles.

FIGS. 17-20 illustrate arrangements of baffles (horizontal and liner) within panels and/or frames formed by rails 102 and 104, stiles 103 and 105 and centre rail 106. A plurality of horizontal baffles 110 are staggered in upper and lower halves of the panels and/or frames. Liner baffles 108 abut top and bottom of panels and/or frames. As shown best in FIG. 19, generally horizontal baffles 110 comprise pointed ends 111. Also shown well in FIG. 19 is resonator 91 formed in part by stile 103 (at the left side). It is to be understood that on opposite side of the panel (not shown) resonators would be on the opposite side.

Insofar as the panel and panel structures may be used as whole or part of a door, it is preferred that the door be of sufficient size to fit in a door frame, for example, about 80 inches tall and 30 inches wide. Ventilation grooves are sufficiently wide to allow air passage there through, for example 0.5 to 1.5 inches, preferably 1 inch. Width of doors varies and with that, the panels and panel structures in accordance with the invention will likewise vary.

The doors, walls, partitions and windows described herein may be made of any suitable material, including wood, metal, glass and the like.

Overall, the panel and/or frame structures of the present invention offer significant advantages in both ventilation and sound dampening, thereby allowing uses over a wide variety of residential, commercial and industrial applications.

It has been discovered that in order to reduce transmission of sound incident on panels:

Vibrations of two panels separated by a sealed airspace are coupled and sound easily transfers through these layers. The vertical groove openings to the airspace within the panels decouples vibrations of the panel(s), so sound energy is dissipated The sound absorptive and vibration damping baffles (for example baffles/blocks) dissipate mechanical vibration energy into heat, fixed on panels to absorb the highest pressure energy closest to the panel Preferably, heavy material is chosen for the solid panels as heavier materials exhibit higher resistance to being moved by sound and transmitting. Aside from the individual smaller resonators, it has been found that the whole panel acts as a Helmholtz resonator as well—i.e. small openings onto a larger cavity.

To reduce transmission of sound travelling through center (air pathway, duct), the panels and frame structures of the invention use:

Reactive damping—Helmholtz resonators in sides/out of air pathway, absorb mid-low frequencies to reduce transmission Dissipative damping—sound absorptive material in cavity shaped and arranged (shaped similar to double wedge airfoils and staggered) to minimize line-of-sight through hollow centre or cavity so it is more likely sound will be incident on the material and be absorbed, while still allowing large open areas for air to flow. Preferred shape of baffles is substantially rectangular although in one aspect, ends may be"pointed". This "long" rectangular shape damps a larger frequency range, extending into lower ranges, for sound travelling normal to duct orientation While the forms of panels, frame structures, method and system described herein constitute preferred embodiments of this invention, it is to be understood that the invention is not limited to these precise forms. As will be apparent to those skilled in the art, the various embodiments described above can be combined to provide further embodiments. Aspects of the present panels, method and system (including specific components thereof) can be modified, if necessary, to best employ the panels, method and system of the invention. These aspects are considered fully within the scope of the invention as claimed. For example, the various methods described above may omit some acts, include other acts, and/or execute acts in a different order than set out in the illustrated embodiments.

Further, in the methods taught herein, the various acts may be performed in a different order than that illustrated and described. Additionally, the methods can omit some acts, and/or employ additional acts.

These and other changes can be made to the present panel, method and system in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

We claim:

1. A panel for ventilation and both reactive and dissipative sound dampening which comprises:

a) a front, a back, a top, a bottom, a right side and a left side defining a hollow centre there between;

b) at least one vertically oriented ventilation groove on the front of the panel (front groove) for passive air passage to the hollow centre and at least one vertically oriented ventilation groove on the back of the panel (back groove) for passive air passage to the hollow centre, wherein the front groove and the back groove are non-linear, staggered and form a Z-shaped air channel within the hollow centre;

c) a plurality of horizontally dispersed, staggered baffles in the hollow centre; and d) a plurality of at least partial resonators on the periphery of the hollow centre.

2. The panel of claim 1 which forms part of at least one of a door, a wall, a window and a partition.

3. The panel of claim 1 wherein the at least partial resonators are on right and left side of the panel.

4. The panel of claim 1 wherein the at least partial resonators are made whole by engagement of the panel with a stile, said stile comprising a remaining portion of the resonators.

5. The panel of claim 1 comprising necks of the resonators on the periphery of the hollow centre, said necks being mate-able with cavities of the resonators disposed within a stile, when said panel and stile are operably engaged.

6. The panel of claim 1 comprising necks of the resonators on the periphery of the hollow centre, said necks being mate-able with cavities of the resonators disposed within a stile, when said panel and stile are operably engaged, thereby forming a Helmholtz resonator, comprising a neck, a cavity and an opening.

7. The panel of claim 1 wherein the at least partial resonators are at least partially filled with sound absorptive material.

8. The panel of claim 1 wherein the at least partial resonators are necks having openings which face the vertically oriented ventilation grooves.

9. The panel of claim 1 wherein the baffles comprise sound absorbing material.

10. The panel of claim 1 wherein the baffles are comprised of at least one of acoustic tiles, fibreglass and acoustical foam.

11. At least one of a door, a wall, a partition and a window comprising at least one panel of claim 1.

12. A door comprising at least one panel of claim 1 set between at least two stiles and at least two rails.

13. A flush door comprising at least one panel of claim 1 set between at least two stiles and at least two rails covered with, at front and back, veneers.

14. A panel system comprising:

a) at least one panel, said panel comprising: a front, a back, a top, a bottom, a right side and a left side defining a hollow centre there between; at least one vertically oriented ventilation groove on the front of the panel (front groove) for passive air passage to the hollow centre and at least one vertically oriented ventilation groove on the back of the panel (back groove) for passive air passage to the hollow centre, wherein the front groove and the back groove are non-linear and staggered and form a Z-shaped air channel within the hollow centre; a plurality of horizontally dispersed, staggered baffles in the hollow centre; and a plurality resonator necks on the periphery of the hollow centre;

b) a rail disposed between every two panels; and c) at least two stiles comprising resonator cavities, said stiles and cavities defining a groove into which resonator necks are mated, to secure panel and stile together.

15. A panel structure for ventilation and both reactive and dissipative sound dampening which comprises a frame disposed between a front surface and a back surface, wherein frame comprises at least two rails and two stiles and a slotted muntin and wherein said frame is disposed between the front surface and the back surface to form a hollow cavity defining in part a Z-shaped airflow pathway, from at least one vertically oriented ventilation groove on the front surface (front groove) for passive air passage to the hollow cavity and at least one vertically oriented ventilation groove on the back surface (back groove) for passive air passage to the hollow cavity, wherein the front groove and the back groove are non-linear and staggered and wherein at a right side and left side of the cavity, through a plurality of slots in the muntin, there are a plurality of resonators; and wherein, pressed between the front surface and the back surface are situate a plurality of staggered horizontally oriented baffles.

16. The panel of claim 15 wherein the baffles comprise sound absorbing material.

17. The panel of claim 15 wherein the baffles are comprised of at least one of acoustic tiles, fibreglass and acoustical foam.

18. At least one of a door, a wall, a partition and a window comprising at least one panel structure of claim 15.

19. The panel of claim 15 wherein foam fills a cavity between slotted muntin and stile.

* * * * *